US005112076A

United States Patent [19]

Wilson

[11] Patent Number: 5,112,076

[45] Date of Patent: May 12, 1992

[54] WHEELCHAIR WITH REMOVABLE SEAT

[76] Inventor: Harold R. Wilson, 1384 Natchez St., Holland, Mich. 49424

[21] Appl. No.: 484,570

[22] Filed: Feb. 23, 1990

[51] Int. Cl.[5] ..... A61G 5/10; A61G 5/04

[52] U.S. Cl. ..... 280/657; 280/304.1; 180/907; 5/81.1; 297/DIG. 4; 414/92.1

[58] Field of Search ..... 280/250.1, 304.1, 638, 280/657; 180/65.1, 6.5, 907; 5/81 R, 86, 83, 85, 88; 187/11; 297/DIG. 4, DIG. 10, 345; 414/921

[56] References Cited

U.S. PATENT DOCUMENTS

| | | | |
|---|---|---|---|
| 503,105 | 8/1893 | Tingley | 5/81 R X |
| 1,094,117 | 4/1914 | Butler | 5/86 |
| 2,339,007 | 1/1944 | Gahm | 5/81 R X |
| 2,498,853 | 2/1950 | Hassold et al. | 5/86 |
| 2,595,651 | 5/1952 | Feist | 5/86 |
| 2,681,455 | 6/1954 | Schwartz | 5/86 |
| 2,792,052 | 5/1957 | Johannesen | 5/83 X |
| 2,892,506 | 6/1959 | Slater | 5/81 R |
| 3,099,020 | 7/1963 | Garfield et al. | 5/81 R |
| 3,285,619 | 11/1966 | Kitrell et al. | 5/81 R |
| 3,394,933 | 7/1968 | Benoit | 5/81 R X |
| 3,623,169 | 11/1971 | James | 5/81 R |
| 3,629,880 | 12/1971 | van Rhyn | 5/86 |
| 3,790,974 | 2/1974 | Johansson | 5/86 |
| 3,905,436 | 9/1975 | Karchak, Jr. et al. | 180/6.5 |
| 3,917,076 | 11/1975 | Campbell | 5/86 X |
| 3,940,808 | 3/1976 | Petrini | 5/86 |
| 3,996,632 | 12/1976 | Bakker nee Viel | 5/83 |
| 3,999,227 | 12/1976 | Ingemansson | 5/86 |
| 4,010,499 | 3/1977 | Davis et al. | 5/81 R |
| 4,157,593 | 6/1979 | Kirstensson | 5/81 R |
| 4,193,147 | 3/1980 | Fischer | 5/81 R |
| 4,240,169 | 12/1980 | Roos | 5/60 |
| 4,255,823 | 3/1981 | Boyer et al. | 5/81 R |
| 4,278,387 | 7/1981 | Seguela et al. | 414/462 |
| 4,375,840 | 3/1983 | Campbell | 180/6.5 |
| 4,399,572 | 8/1983 | Johansson | 5/81 R |
| 4,477,117 | 10/1984 | Higgs | 297/45 |
| 4,527,829 | 7/1985 | Fanslau et al. | 297/17 |
| 4,569,094 | 2/1986 | Hart et al. | 5/81 R |
| 4,592,562 | 6/1986 | Strautnieks et al. | 280/250.1 |
| 4,631,761 | 12/1986 | Lederman | 5/81 R |
| 4,669,943 | 6/1987 | Zamotin | 414/343 |
| 4,704,749 | 11/1987 | Aubert | 5/81 R |
| 4,719,655 | 1/1988 | Dean | 5/81 R |
| 4,737,997 | 4/1988 | Lamson | 280/304.1 |
| 4,856,123 | 8/1989 | Henderson et al. | 5/81 R |
| 4,862,997 | 9/1989 | Eberle | 187/11 |
| 4,890,853 | 1/1990 | Olson | 5/81 R X |

FOREIGN PATENT DOCUMENTS

| | | | |
|---|---|---|---|
| 0067069 | 12/1982 | European Pat. Off. | 280/304.1 |
| 1316673 | 6/1987 | U.S.S.R. | 180/6.5 |
| 2135183 | 8/1984 | United Kingdom | 280/250.1 |

*Primary Examiner*—Andres Kashnikow
*Assistant Examiner*—Brian L. Johnson
*Attorney, Agent, or Firm*—Flynn, Thiel, Boutell & Tanis

[57] ABSTRACT

A wheelchair including a wheeled base assembly provided with an upright assembly thereon, the latter including a pair of telescopic vertical post arrangements which are provided adjacent the front corners of the wheelchair and are vertically extendable and retractable. The upright assembly includes a pair of arms which are secured and cantilevered rearwardly from the upper ends of the upright post arrangements. A seat arrangement is removably attached to and positioned between the arms to facilitate transferring of an occupant, along with the seat assembly, either to or from the wheelchair.

8 Claims, 6 Drawing Sheets

WHEELCHAIR WITH REMOVABLE SEAT

FIELD OF THE INVENTION

This invention relates to an improved wheelchair for use by invalid or handicapped persons, which wheelchair provides significantly increased mobility and transferability of the occupant while being compact and durable.

BACKGROUND OF THE INVENTION

Numerous wheelchairs have been developed for both residential and commercial use, including motorized wheelchairs. Some of these have provided limited vertical adjustability, and others have attempted to permit transfer of a occupant either onto or off of the wheelchair, such as by providing a removable seat. These prior structures, however, have proven to be less than desirable since most have not provided both a durable and simple structure while permitting vertical adjustability, nor have they provided a structure which can be safely and conveniently manipulated to permit transfer of the occupant, such as when the seat is being transferred.

Rather, particularly in medical facilities, transfer of patients is still accomplished primarily by using lift devices wherein a wheeled frame is provided with a single vertically extendable upright post having a support arm projecting cantilevered from the upper end thereof, which arm at its free end has a slinglike flexible seat suspended therefrom for supporting a patient. Such mechanisms do not function as wheelchairs, however, but solely as lifting and transfer devices. Further, such devices are frightening to the patient since the patient is supported solely by the suspended flexible seat arrangement and does not have the comfort and security of being seated within a chair structure.

With respect to wheelchairs which have been developed for home use, while many such chairs have been motorized, nevertheless the known chairs have either provided no or only limited capability of permitting the occupant to raise and lower the seat, and have not permitted transfer from the chair. While various complex specialized chairs and transfer mechanisms have been developed to assist in transferring the patient into or out of a vehicle, including transfer to or from the vehicle and the wheelchair, nevertheless most of these devices have been extremely specialized, cumbersome and expensive, and hence have not permitted simplified and efficient transfer from a seemingly conventional wheelchair.

Accordingly, it is an object of the present invention to provide an improved wheelchair which is believed to represent a significant improvement over many of the wheelchairs and lifting devices which have been heretofore utilized.

More specifically, it is an object of this invention to provide an improved wheelchair which can be utilized so as to function in a manner which corresponds to a conventional wheelchair, whereby an occupant can comfortably sit in and comfortably utilize the wheelchair, but which also provides greatly improved flexibility in terms of permitting transporting and transferring of the occupant. In particular, the improved wheelchair includes improved capability of permitting raising and lowering of the occupant, and at the same time permitting transferring of the occupant either onto or off of the wheelchair by means of a seat arrangement which can be readily attached to or detached from the wheelchair.

A further object of the invention is to provide an improved wheelchair, as aforesaid, which in one variation is particularly desirable for use in medical facilities so as to improve the transportability and transferability of patients in a safe and secure manner while requiring only minimal assistance from the medical facility personnel, such as permitting transfer of a patient while being assisted by only a single person.

Still a further object of the invention is to provide a wheelchair which, in a further variation, is self-propelled and highly desirable for use in a residence or the like so as to enable the occupant to control his/her own movement throughout the building, which wheelchair enables the occupant to have significant control over the vertical height of the seat to greatly improve the flexibility of the chair, and at the same time permits the occupant to be readily transferred to or from the chair, such as permitting transfer into a vehicle or the like.

Another object of the invention is to provide a wheelchair, as aforesaid, which is durable and relatively simple in construction, and is also economical to manufacture.

SUMMARY OF THE INVENTION

The improved wheelchair includes a wheeled base assembly provided with an upright assembly thereon, the latter including a pair of telescopic vertical post arrangements which are provided adjacent the front corners of the wheelchair and are vertically extendable and contractible. The upright assembly includes a pair of arms which are secured and cantilevered rearwardly from the upper ends of the upright post arrangements. A seat arrangement is removably attached to and positioned between the arms to facilitate transferring of an occupant, along with the seat assembly, either to or from the wheelchair.

In the improved wheelchair, as aforesaid, the upright post arrangements each include a lower upright post element which has its lower end fixed to the base and which slidably and telescopically supports an upper upright post element, the latter having the arms secured to the upper ends thereof. A drive arrangement, including an elongate drive element such as a drive screw, is disposed within each of the post arrangements and is drivingly connected to a drive shaft which is mounted on the base. A power unit, such as a battery-powered drive motor, is provided on the base for driving the shaft. The battery can also optionally be utilized for effecting driving of some of the wheels on the wheelchair, if desired.

In the improved wheelchair, as aforesaid, the seat assembly is suspended from the arms by suspension elements which are coupled between the seat and the arms, such as at locations disposed adjacent the front ends of the arms. The suspension elements are provided with couplings at opposite ends which permit them to be readily detached from the arms to facilitate transfer of the occupant when desired. The region of the wheelchair between the upright posts and the arms is free of obstructions so as to permit ready access of the occupant into the seat from the front side thereof when it is mounted on the wheelchair, and to also permit the occupant and the seat to be readily transferred onto or off from the wheelchair from the rear side thereof.

In the improved wheelchair, as aforesaid, the base assembly includes a rigid U-shaped base which is provided with wheels so as to be disposed close to the floor and oriented so as to open rearwardly, whereby the region between the side legs of the base is freely open to the rear so as to permit it to readily straddle other objects. The base supports thereon a unitized power arrangement which contains batteries and other controls for the wheelchair, which power arrangement can be readily removed from the base when desired. In a variation of the wheelchair which is particularly suitable for home use, the base and upright assemblies can be readily detached from one another, and the upright assembly partially folded or collapsed, to facilitate storage or transfer into or out of an automobile.

Other objects and purposes of the wheelchair according to the present invention will be apparent to persons familiar with structures of this general type upon reading the following specification and inspecting the accompanying drawings.

Figures 1, 2:
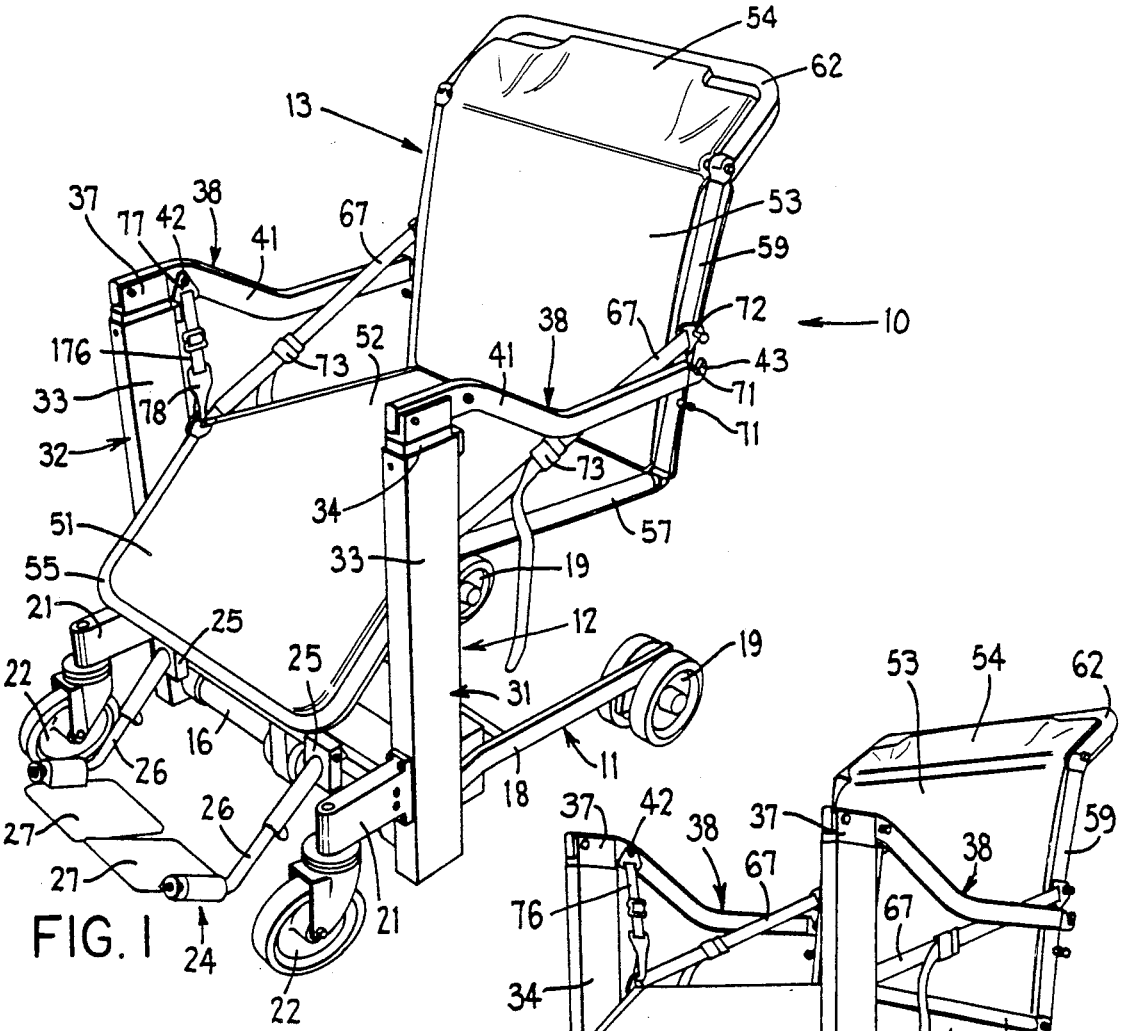
FIG. 1 is a perspective view of a first variation of the wheelchair as shown in its lowered position.
FIG. 2 shows the wheelchair of FIG. 1 in its uppermost position.
Figure 3:
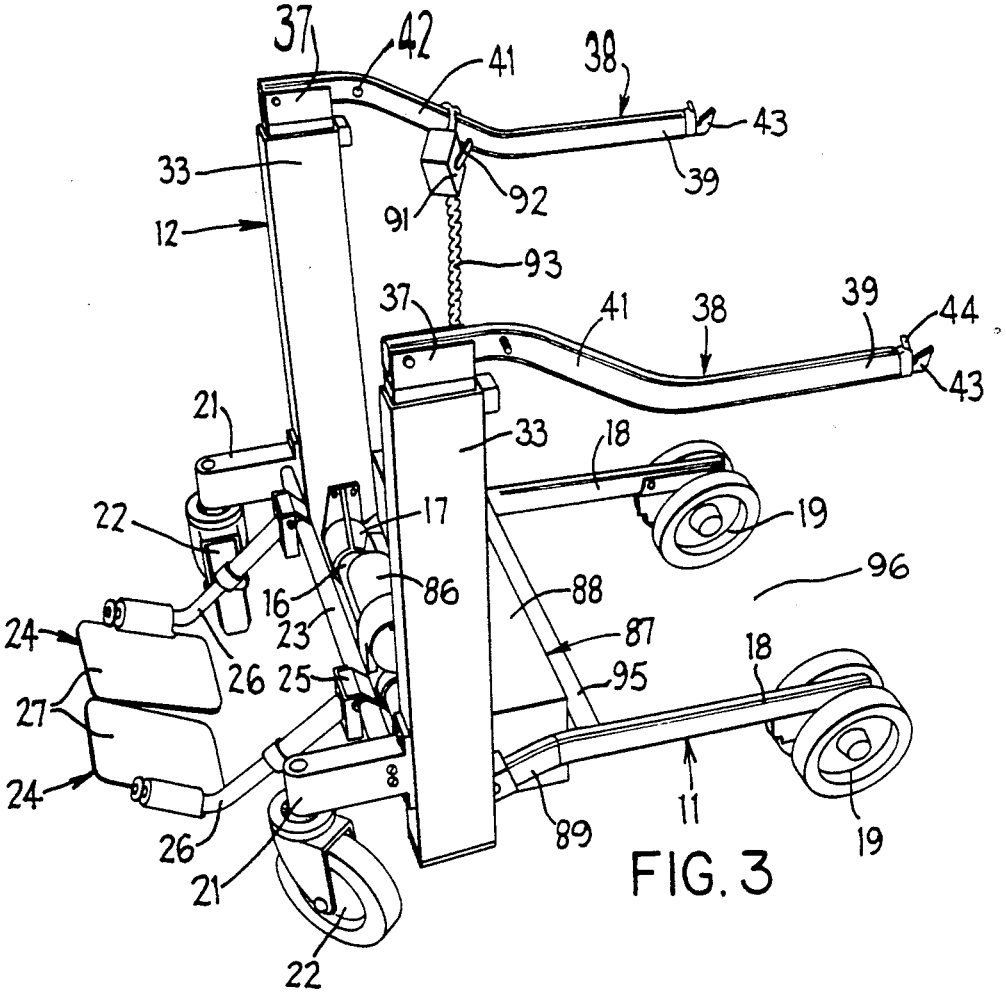
FIG. 3 shows the wheelchair with the seat assembly removed.

Certain terminology will be used in the following description for convenience in reference only, and will not be limiting. For example, the words "upwardly", "downwardly", "rightwardly" and "leftwardly" will refer to directions in the drawings to which reference is made. The word "front" will refer to the side of the wheelchair through which the occupant normally enters or exits the chair, this being the left side in FIGS. 1 and 2. The words "inwardly" and "outwardly" will refer to directions toward and away from, respectively, the geometric center of the wheelchair and designated parts thereof. Said terminology will include the words specifically mentioned, derivatives thereof, and words of similar import.

DETAILED DESCRIPTION

Description of FIGS. 1-8

FIGS. 1-8 illustrate a first variation of a wheelchair 10 according to the present invention, which wheelchair 10 is particularly desirable for use in medical facilities such as hospitals, nursing homes and the like.

The wheelchair 10 includes a wheeled base assembly 11 having an upright assembly 12 mounted thereon and projecting upwardly therefrom. This upright assembly 12 in turn mounts thereon a removable seat assembly 13, the latter being used for receiving an occupant both for transporting by the wheelchair and transfer to and from the wheelchair.

The wheeled base assembly 11 includes a generally U-shaped base which is disposed close to the floor and opens rearwardly. The U-shaped base has the bight thereof defined by a support tube 16 which extends horizontally and transversely across the wheelchair adjacent the front side thereof. This support tube 16 has opposite ends thereof mounted within brackets 17. The brackets 17 are fixedly secured to the upright assemblies 12. The forward ends of a pair of generally parallel and rearwardly projecting cantilevered side legs 18 are rigidly secured to the brackets 17. These side legs 18 at their rearward or free ends mount rear wheel assemblies 19, each of which assemblies preferably comprise a pair of wheels disposed in straddling relationship to the side leg 18.

The base assembly 11 also includes a pair of front side legs 21 which project forwardly a small extent in generally parallel relationship, and are forwardly cantilevered so as to mount thereunder, adjacent the free end, a front support roller 22, the latter preferably being of the caster type. The front and rear wheels 22 and 19 are of substantially the same diameters.

The front support legs 21 are fixedly secured to the lower end of the upright assembly 12. A support bar 23, which is spaced slightly forwardly from and vertically above the support tube 16, extends between and is rigidly joined to the front support legs 21.

The support bar 23 mounts thereon right and left foot supports 24. Each of these foot supports includes a bracket 25 which removably attaches to the bar 23 and has a forwardly and downwardly projecting arm 26 which, at its outer end, pivotally supports thereon a conventional foot plate 27. The structure of the foot support 24 is conventional and well known.

Considering now the upright assembly 12, it is defined principally by a pair of vertically elongate and telescopic support post assemblies 31 and 32 which are disposed on opposite sides of the wheelchair in the vicinity of the front corners thereof. The assemblies 31 and 32 are substantially identical (i.e., mirror images of one another).

The assemblies 31 and 32 each include a vertically elongate lower support post 33 which has the lower end thereof rigidly secured to the base, such as to the front support leg 21 and the bracket 17 as discussed above. The lower part of the post 33 effectively functions as part of the rigid base. This post 33 is of tubular construction and projects vertically upwardly a significant extent, and vertically slidably telescopically receives therein an upper support post 34.

The upper and lower support posts 34 and 33, respectively, are each preferably of tubular construction so as to maximize the strength thereof, and the upper post 34 at the lower front side thereof carries a first guide roller 35 (FIG. 7) which vertically rollingly moves along the inside front wall of the lower post 33. This lower post 33 in turn mounts a further guide roller 36 at the upper end thereof for rolling engagement with the rear exterior side of the upper post 34. These rollers facilitate free vertical displacement of the upper post 34 during raising and lowering, and at the same time provide for maximum resistance to the load-imposed moments imposed on the lower post by the upper post when the wheelchair has an occupant supported therein. The inner upper end of post 33, and the lower outer end of post 34, also preferably have Delrin slide bearings fixed thereto to facilitate the vertical sliding between the posts.

The support posts 33 and 34 preferably have rectangular cross sections and also preferably have a tubular cross sectional dimension in the front-to-rear direction which is substantially greater (such as about a 2:1 ratio) than the tubular cross sectional dimension in the sideward direction. This permits the overall sideward dimension or width of the support posts to be minimized so that the overall wheelchair width can be minimized but at the same time provides the support tubes with significant bending strength so as to withstand the significant bending loads imposed on the support posts when the seat is occupied.

Each upper post 34, at the free upper end thereof, mounts a bracket 37 which is rigidly attached to the forward end of a seat support arm 38, which support arm projects rearwardly in a cantilevered fashion along the side of the chair so as to terminate in a free end 39. The support arms 38 project rearwardly from the upper posts 34 in generally parallel relationship and are sidewardly spaced apart so that they are generally disposed approximately over the rear side legs 18, whereby the arms 38 accommodate the seat assembly 13 therebetween, as explained below.

The rearward portions of the support arms 38 are disposed at an elevation such that they can function as armrests for the occupant of the wheelchair. However, the arms 38, in the forward portions thereof, are provided with upwardly inclined parts 41 which are provided so that the forward ends of the arms, at the points of attachment to the brackets 37, are somewhat elevated. This permits the post assemblies 31 and 32 to have increased vertical displacement to enable the wheelchair to be vertically displaced between the lowered and raised positions illustrated by FIGS. 1 and 2, respectively.

Figure 8:
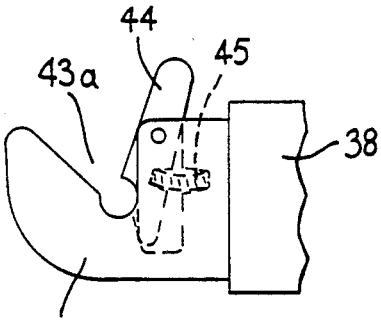
FIG. 8 is an enlargement of the catch at the end of the support arm.
Figure 7:
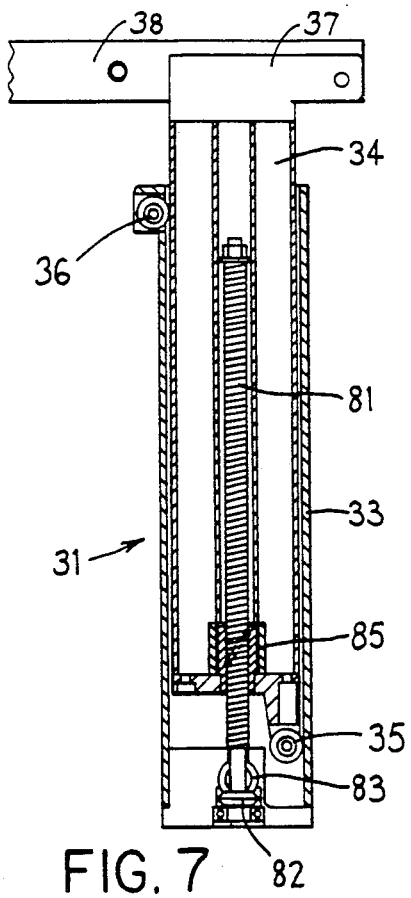
FIGS. 6 and 7 are sectional elevational views of the extendable post arrangement.
Figure 6:
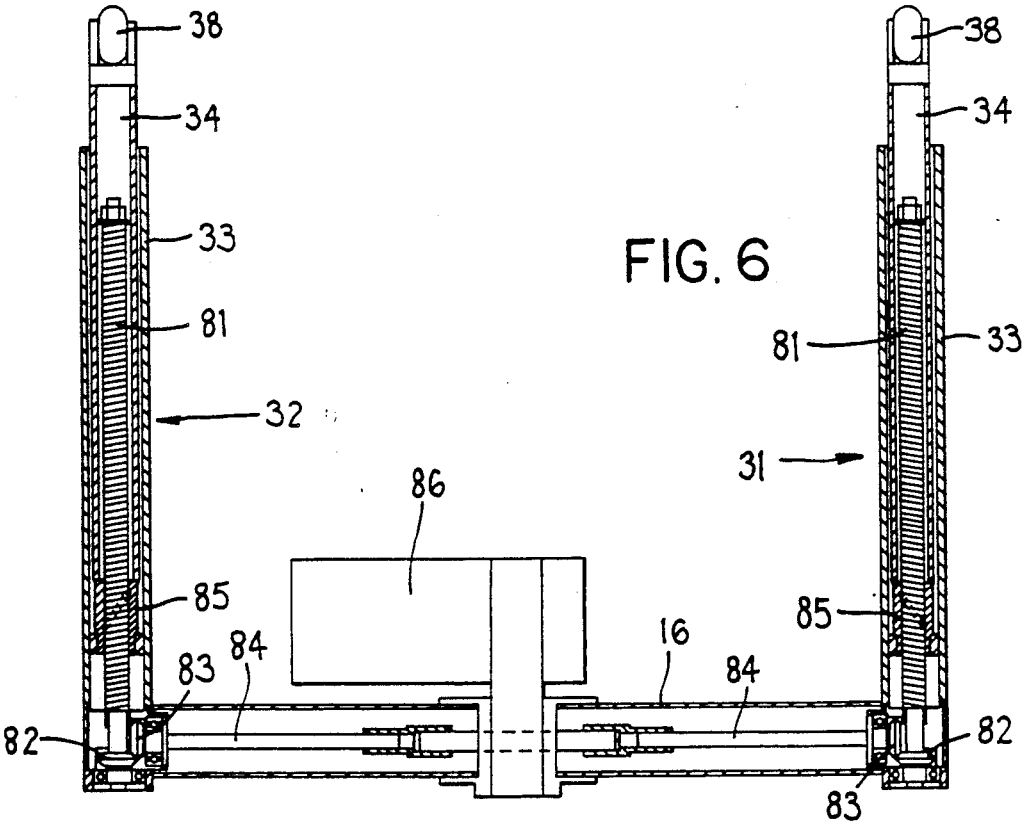

Each of the support arms 38 has, in the vicinity of the front end thereof, a pinlike seat-support element 42 projecting inwardly from the inner side thereof. The rear free end of each arm 38 also has a support catch or claw 43 which defines an upwardly opening notch 43*a*, which notch is normally maintained closed by a spring 45 or gravity urged latch 44 which is movably, here pivotally, supported on the respective support arm (FIG. 8).

Figure 4:
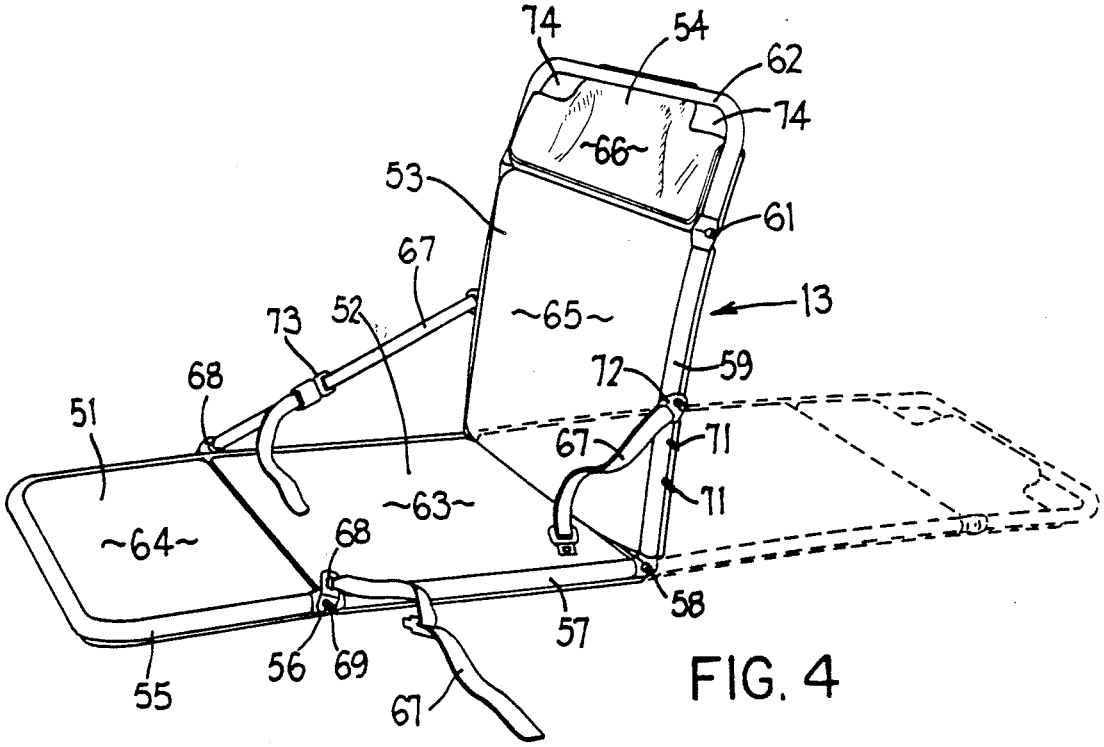
FIG. 4 shows the removed seat assembly.

The seat assembly 13, as illustrated by FIG. 4, includes a leg support portion 51 hingedly joined to a seat portion 52, which in turn is hingedly joined to a backrest portion 53, and it in turn is hingedly joined to a top portion 54 which functions either as a headrest or as a handle. The seat assembly can be formed so that the seat portion and backrest portion project transversely as indicated by solid lines in FIG. 4, or can be flattened so as to define a flat stretcher. To provide this preferred structure, the footrest portion 51 includes a tubular frame member 55 which defines the lower and opposite side edges, and these side frame edges are joined via a horizontal hinge 56 to the front ends of side rails 57 associated with the seat portion 52. The rearward ends of side rails 57 are joined by a hinge 58 to the lower ends of the side rails 59 defining the backrest portion 53. These side rails 59 at their upper ends are joined by a hinge 61 to the U-shaped frame element 62 which defines the side and top edges of the top portion 54. The hinges 56, 58 and 61 are all preferably friction type hinges which are sufficiently snug so as to permit the adjacent portions to remain in the selected relative position, but permit the adjacent portions to be relatively hinged by application by suitable manual force.

All of the portions of the seat are also preferably provided with a suitable covering. For example, the seat portion 52 has a support or covering 63 which is stretched tautly between the side rails 57 so as to effectively function as a seat for the wheelchair occupant, and a similar covering 64 extends across the foot portion 51. The covering 63 and 64 can be part of one integral piece of material if desired. A further covering 65 extends between the side rails 59 to define the backrest, and a similar covering 66 is supported by the top rail 62 to define the top portion of the seat assembly. These coverings are all preferably of a flexible fabric or plastic material to provide limited yieldability or resiliency so as to improve the comfort of the wheelchair occupant. Further, these coverings can all be attached to the frame in a removable manner, if desired, to facilitate replacement of the coverings.

To permit the seat and back portions 52 and 53, respectively, to be supported and maintained in transverse relationship so as to support an occupant, such as illustrated by the solid line position of FIG. 4, the seat assembly also includes a pair of side supports 67 which are provided for joining the portions 52 and 53 together in the desired angled relationship. Each side support 67 is preferably formed as an elongate flexible strap having, at the lower front end thereof, a clip 68 provided with an opening therethrough for releasable engagement with a pinlike attachment element 69 which projects sidewardly from the seat rail 57 adjacent the front end thereof. This support element 69 in the illustrated embodiment is defined by the sidewardly projecting end of the hinge pin or bolt 56, but such element could be separate from the hinge pin if desired.

The side rail 59 of the backrest 53 has a plurality of similar pinlike support elements 71 projecting sidewardly therefrom at spaced intervals therealong, with the uppermost of these elements 71 being approximately midway between the ends of the side rail 59. The rear end of the strap 67 has a clip 72 having an opening therethrough for engagement with a selected one of the elements 71, with the clip 72 and selected element 71 being secured by a removable retaining ring. The support strap 67 is preferably formed in two pieces which are joined together by a conventional adjustable but releasable clasp 73, which clasp permits the length of the strap 67 to be adjusted so as to permit the angle between the seat and back portions to be selected, but at the same time the clasp 73 can be easily manually separated, such as illustrated by the left side support strap 67 in FIG. 4. The structure of such clasp is conventional so that a detailed explanation thereof is believed unnecessary.

In use, such as when the seat assembly is mounted on the wheelchair, the leg support portion 51 can be pivoted downwardly if desired to provide support beneath the legs, such position being illustrated by FIGS. 1 and 2. Further, the top portion 54 can be tilted rearwardly so as to be in transverse relationship to the backrest portion 53, whereby this top portion 54 and specifically the end rail 62 can be used as a handle to permit a person, such as a hospital technician or aid, to grasp the rail 62 so as to propel and control the wheelchair. For this purpose, the covering 66 is preferably provided with cutouts 74 at the corners to function as hand holes.

To secure the seat assembly 13 to the upright assembly 12, the seat assembly 13 is secured or joined to the pair of cantilevered support arms 38 adjacent the front and rear ends thereof so as to effectively define a four-point support. The two rearward-most support points are defined by the claws 43 defined at the free rearward ends of the support arms 38, which claws 43 receive in the grooves or notches thereof a pair of the support pins 71 which project outwardly from opposite sides of the backrest 53. The pins 71 are securely held within the claws by means of the latch elements 44, whereby removal of the pins from the claws is possible only by first manually pivoting the latch elements 44 forwardly so as to release them.

Figure 5:
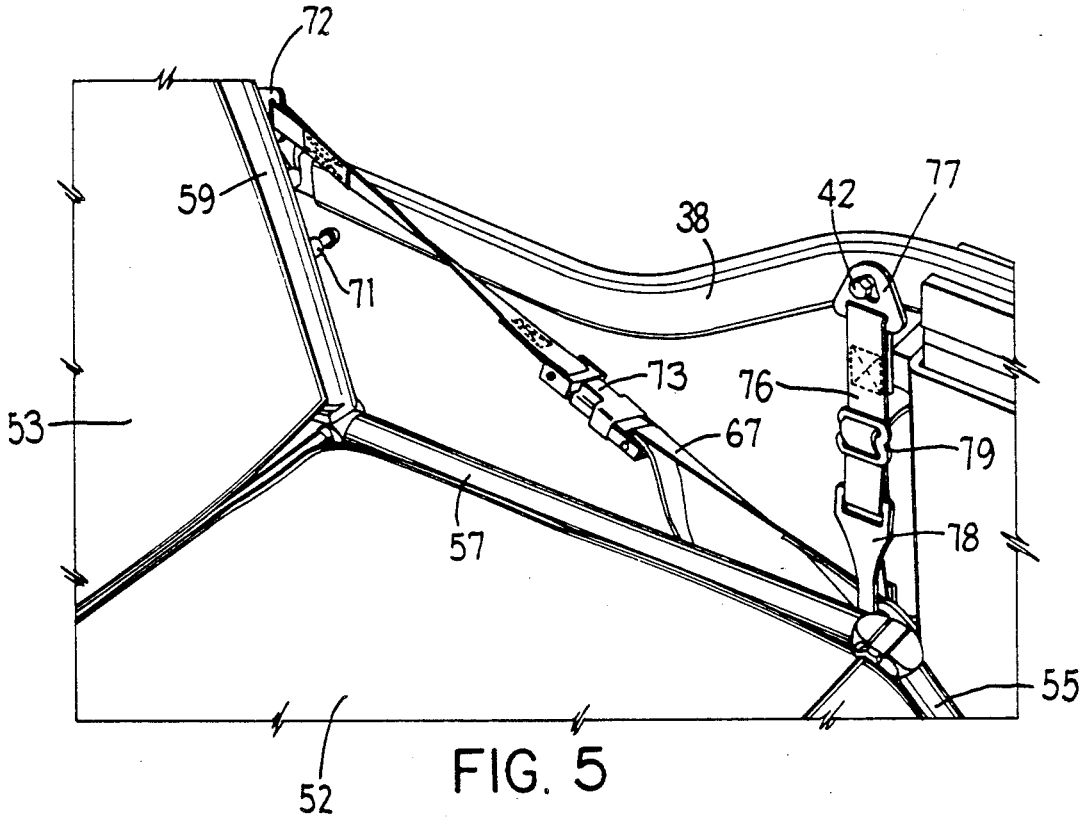
FIG. 5 is a fragmentary perspective view showing the attachment structure for the removable seat assembly.

The front of the seat assembly is suspended from the support arms 38 adjacent the forward ends thereof. For this purpose each support arm 38 has a flexible support element or strap 76 which, as shown in FIG. 5, has a clip 77 or selected element at its upper end provided with a keyhole-like slot or opening therethrough for accommodating the support pin 42 which projects inwardly from the side of the support arm 38. This support strap 76 at its lower end has a manually-releasable springlike clip 78 which can be engaged through an opening formed in the clip 68 provided on the front end of the side support strap 67. This suspension strap 76 also preferably has a conventional adjustment buckle 79 associated therewith so as to permit the elevation of the front of the seat portion to be adjusted relative to the support arm 38. Due to the manner in which the clip 78 engages the clip 68, the suspension strap 76 will normally remain attached to the seat assembly, and the disattachment point occurs between the clip 77 and the support pin 42. However, the suspension straps 76 have been eliminated from FIG. 4 for clarity of illustration.

To permit powered raising and lowering of the support post assemblies 31 and 32 and the seat assembly 13 which is mounted from the arms 38, each of the post assemblies includes an actuator which, in the illustrated embodiment, includes a vertically elongate screw shaft 81 which projects vertically throughout the extent of the lower support post 33. This threaded shaft 81 is rotatably supported in the post 33 and, adjacent its lower end, has a bevel gear 82 thereon which meshes with a further bevel gear 83 secured to the adjacent end of a drive shaft 84, the latter being rotatably supported within and extending along the support tube 16. The threaded shaft 81 is threadably engaged within a ball nut 85 which is fixed to and defines the lower end of the upper post 34 so that rotation of the drive shaft 81 in one direction or the other causes corresponding vertical displacement of the upper post 34 either upwardly or downwardly, respectively.

The drive shaft 84 is coupled to a drive motor 86, such as a conventional reversible gear motor, the latter being mounted on the support tube 16.

To permit powering of the drive motor 86, the base assembly mounts thereon a power supply 87 which includes a generally boxlike housing 88 or tray which is positioned directly behind the support tube 16 and extends transversely between and is supported on the opposed side legs 18. The housing 88, which normally includes a removable cover, is preferably provided with yokelike side handles 89 which are formed so as to overlie the side legs 18 and hence permit the power supply 87 to be securely supported thereon but easily removed therefrom.

This power supply 87 includes a conventional power source such as a 12-volt battery, the latter being coupled through suitable cables and separable connections, all of a conventional nature, to the drive motor 86.

To control energization of the drive motor 86 from the power source 87, the wheelchair is provided with a control box 91 having a conventional three-position switch 92, such as a toggle switch, which can be manually activated by the wheelchair assistant so as to drive the motor either in a forward or a reverse orientation so as to cause respective raising or lowering of the support post assemblies 31 and 32. This control box 91 is preferably joined to the control circuitry disposed within the power source 87 by a flexible stretch cable 93 to facilitate it to be lifted upwardly for easy access by the wheelchair assistant, but also enabling it to be readily stored on or attached to the power source 87 if desired.

The base of the wheeled base assembly is also provided, adjacent or slightly rearwardly of the power supply 87, a reinforcing rod 95 extending transversely between and rigidly joined to the opposed side legs 18. However, the region 96 which is located rearwardly of this cross bar 95 but between the opposed side legs 18 opens freely rearwardly between the sidewardly spaced rear wheel assemblies 19. Further, the region which is located vertically between the lower side legs 18 and the support arms 38, which region is disposed rearwardly of the post assemblies 31 and 32, is freely open and accessible from both sides and from the rear.

OPERATION

The wheelchair is typically in the lowered position illustrated by FIG. 1 when utilized for transporting an occupant. With an occupant in the chair, the assistant grasps the handle or rail 62 and pushes the chair so as to wheel the occupant to a desired location.

If it is desired to transfer the occupant from the chair onto another surface, such as a bed which is typically at an elevation higher that the seat portion 52, the wheelchair is initially positioned adjacent the bed so that the back of the wheelchair is adjacent the side of the bed. The assistant then activates the switch 92 so as to raise the support posts 31 and 32 until the seat portion 51 is at an elevation slightly above the upper surface of the bed. The assistant then manually pushes the wheelchair rearwardly so that the rear legs 18 project under the bed, which rearward movement occurs until the side of the bed substantially abuts the vertically extending post assemblies 31 and 32. At this time, or slightly therebefore, the assistant may swing the leg support portion 51 of the seat assembly upwardly so as to be approximately aligned with the seat portion 52. After the wheelchair has been pushed rearwardly so that the side of the bed substantially abuts the inner surfaces of the post assemblies 31 and 32, this results in the seat portion 52 being disposed directly over but slightly above the upper surface of the bed. The operator then activates switch 92 so that the drive motor is energized to effect lowering of the post assemblies 31 and 32, which lowering continues until the seat portion 52 initially contacts the upper surface of the bed. The posts are then lowered a small additional amount so as to relieve the tension in the front seat support straps 67. During this lowering, the latches 44 are also manually released, whereupon the pins 71 lift upwardly out of the claws 43. The assistant then disconnects the clips 77 on the suspension straps 76 from the support pins 42, whereby the seat assembly is totally disconnected from the wheelchair and is supported directly on the upper surface of the bed. The assistant then moves the wheelchair, as appearing in FIG. 3, out of the way so as to provide full access to the bed-supported seat assembly and the occupant seated thereon.

The assistant then horizontally pivots the seat assembly so that the seat portion 52 and the attached leg support portion are rotated substantially 90 degrees so as to extend lengthwise of the bed. The assistant then provides support with one hand behind the backrest 53, and then releases the clasps 73 associated with the side straps 67, following which the assistant partially supports the backrest 53 and assists in controlling backward pivoting thereof so that the seat assembly and the occupant are lying generally flat on the bed, such as illustrated by the dotted position of the seat assembly in FIG. 4. When in this latter position, the assistant then slides or rolls the occupant partially onto the bed, and then slides the flattened seat assembly out from beneath the occupant, thereby leaving the occupant properly positioned on the bed.

Thereafter the seat assembly can be reattached to the wheelchair if desired, or alternatively the seat can be left in the room for use with the same occupant, and the wheelchair then moved to a further location and a different seat assembly attached thereto for use with a different occupant.

If it is desired to move an occupant from a bed into the wheelchair, then the sequence for doing such is basically the reverse of the sequence described above.

While the operation of transferring a patient from the wheelchair onto a bed or other surface, and vice versa, can be handled by a single assistant if desired, in some instances it may be preferable to use two assistants. Such transfer operation, however, is highly desirable since all of the lifting and transferring of the patient is borne primarily by its lifting posts provided on the wheelchair, and thus the assistants are not subjected to undesired lifting and consequent back strain. This wheelchair and its lifting capability, and its capability of transferring patients, not only provides for improved safety of the patient or occupant, but also improves the safety for the assistant.

DESCRIPTION OF FIGS. 9-13

FIGS. 9-13 illustrate a second variation of a wheelchair 10' according to the present invention. This wheelchair 10' incorporates many of the same structural and functional relationships which are possessed by the wheelchair 10 of FIGS. 1-8, and corresponding parts thereof have been designated by the same reference numerals but with the addition of a prime (') thereto. Because of the similarity of the structure and function, these corresponding parts will not again be described in detail.

Figure 9:
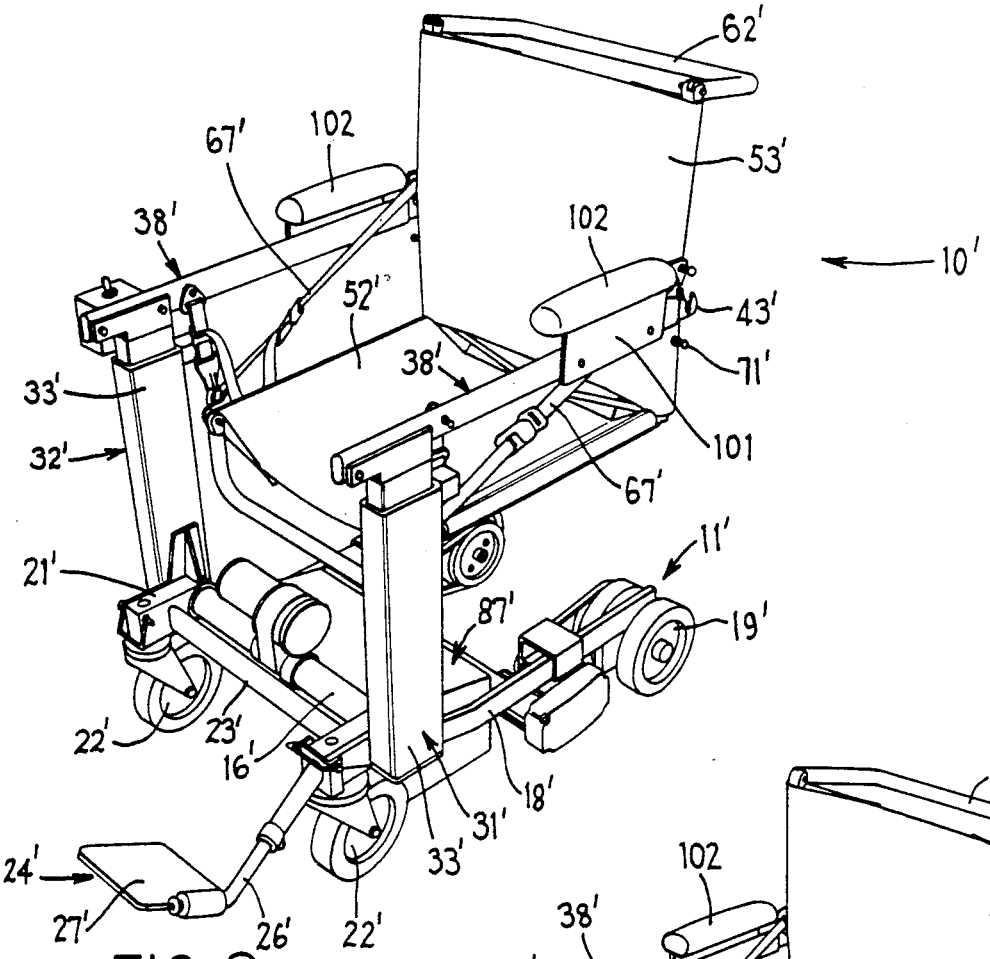
FIG. 9 is a perspective view showing a second variation of the wheelchair in its lowered position.
Figure 10:
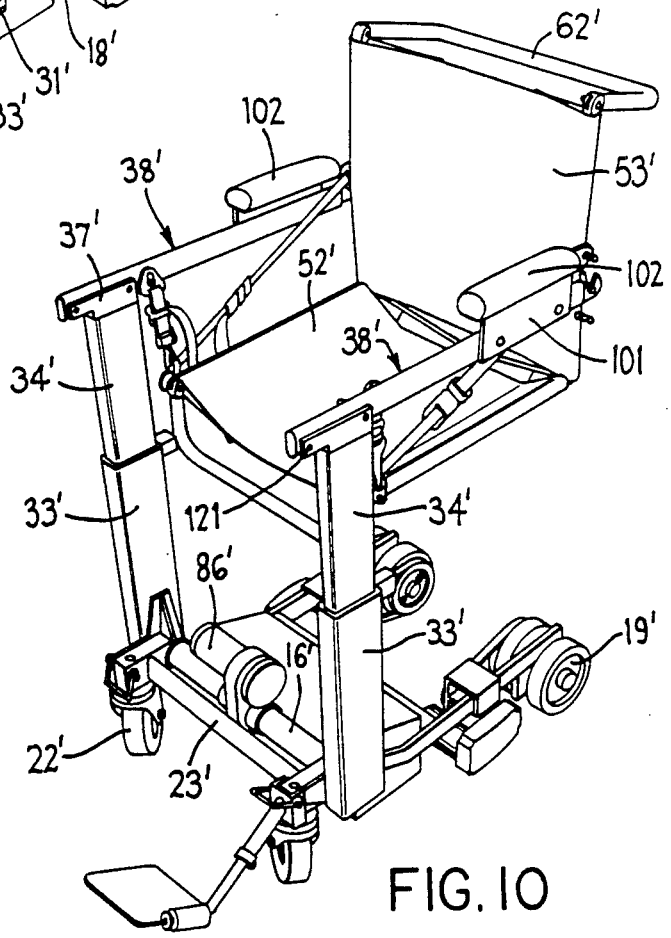
FIG. 10 shows the wheelchair of FIG. 9 in its upper position.
Figure 11:
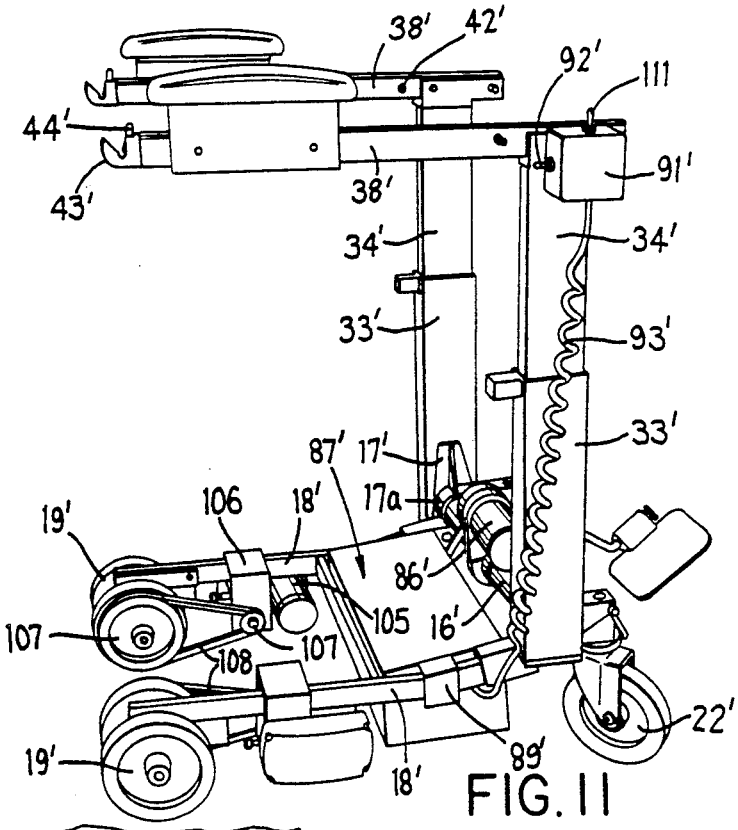
FIG. 11 shows the wheelchair of FIG. 9 with the seat assembly removed.
Figure 13:
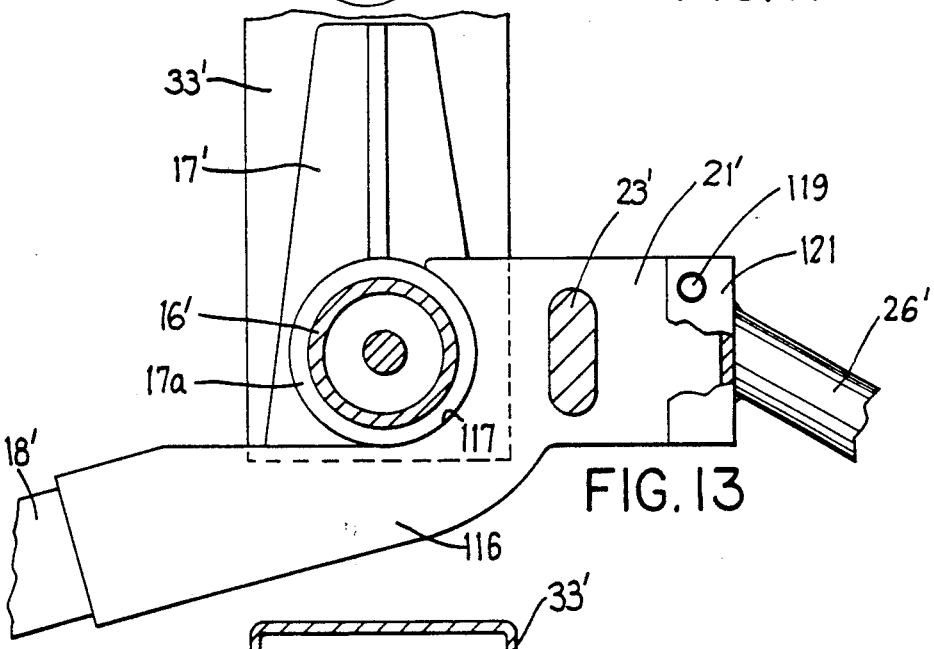
FIGS. 12 and 13 are enlarged, fragmentary sectional views showing the arrangement between the base and upright assemblies.

The wheelchair 10' is intended primarily for use in facilitating the movement of a handicapped person within the home, and the movement of such person to and from a vehicle, and through commercial businesses such as department stores and the like. For this reason, the wheelchair 10' is of slightly smaller construction. For example, the elevating support post assemblies 31' and 32' provide for a smaller vertical lift, as illustrated by FIG. 9, than the wheelchair 10. Further, the overall width of the wheelchair 10' is smaller so as to enable movement through most residential doorways. In fact, the wheelchair 10' has a maximum width, as measured between the outside surfaces of the posts 33', which is slightly less than 24 inches so as to permit movement through doorways having a width of 24 inches or more.

In addition, the rearwardly projecting cantilevered support arms 38' are normally straight so as to project horizontally rearwardly from the top of the post arrangements, and the elevation of the arms 38' is such that, when the post arrangement is in a lowermost position illustrated by FIG. 9, the arms 38' will be positionable beneath a table of standard height. To provide an arm rest of more convenient height for the chair occupant, the support arms 38' have, adjacent the rearward free ends thereof, arm rest brackets 101 which project upwardly and mount thereon cushioned arm rests 102 so as to provide comfortable supports for the occupant's arms. These arm rests 102 preferably project forwardly from the rear free end of the arms through a distance equal to no more than about one-half the length of the support arms 38'.

This wheelchair 10' is also self-propelled. For this purpose an electric drive motor 105 is mounted on each of the rear support legs 18', which drive motor in turn drives a gear box 106. The latter has an output pulley 107 for driving a belt 108 which is engaged with a driven pulley 109 secured to the innermost wheel of the rear wheel assembly 19'. An identical such drive arrangement is provided on each lower rear rail 18' for driving each of the rear wheel assemblies 19'.

To control driving of the rear wheels 19', the control box 91' has a further joy-stick type potentiometer or switch 111 provided thereon. This switch 111 is a multiple position arrangement of conventional construction and, when moved forwardly, energizes both motors 105 to drive the wheelchair forwardly, and when moved rearwardly the motors are reversely energized so as to permit reverse movement of the wheelchair. When switch 111 is activated rightwardly, then only the motor 105 on left side rail 18' is energized to cause the wheelchair to turn to the right except that a sharp right turn also reversely energizes the motor for the right rear wheel, and similarly pushing of the switch 111 to the left energizes only the motor on the right side rail so as to cause the wheelchair to turn to the left except that a sharp left turn also reversely energizes the left rear wheel. The switch or control 111 can assume many conventional configurations, and hence is not described in greater detail.

The switch control box 91' is preferably removably attached within a mounting bracket secured to the outer upper side of the top posts 34', which bracket permits the control box 91' to be lifted upwardly and detached so as to minimize the overall width of the wheelchair and permit movement through doorways of minimal width.

The motors 105 are electrically connected to the power source 87' in a conventional manner.

The wheelchair 10' is also constructed so as to permit it to be readily disassembled into several primary components so as to facilitate its transportability, such as in an automobile. For example, while the seat assembly 13' is removable in the same manner as described above, the wheelchair 10' also permits the upright assembly 12' to be disconnected from the wheeled base assembly 11', and the upright assembly 12' can be partially folded for compact storage, as described below.

To permit disconnection between the upright and wheeled base assemblies, the side legs 18' of the base have support brackets 116 fixedly secured to the forward ends thereof, which support brackets 116 have forwardly projecting rectangular parts which define the front support legs 21' to which are mounted the front casters 22'. These legs 21' are rigidly joined together by the cross bar 23'. The support tube 16' is, in this instance, fixedly secured between and carried with the lower support posts 33' so that the support tube 16' remains with and comprises a part of the upright assembly 12' when the latter is disconnected from the base assembly.

To permit connection of the upright and base assemblies, each of the front support brackets 116 defines on the upper side thereof a rearwardly facing bearing recess 117 which is close to but slightly less than of 180 degree extent. This bearing recess has a diameter corresponding to the outer diameter of the hub 17*a* of the support bracket 17' so as to snugly accommodate the support bracket therein.

To permit rigid attachment of the upright assembly to the base assembly, each of the lower support posts 33' has a mounting plate 118 fixedly secured to the lower inner face thereof, which plate 118 is an integral part of bracket 17' and projects forwardly so as to overlap the side of the front support leg 21'. A securing pin 119 projects through aligned openings formed in the support plate 118 and the leg 21' so that this pin, in conjunction with the support of the tubes 16' within the bearing 117, rigidly secures the upright assembly to the base assembly.

Figure 12:
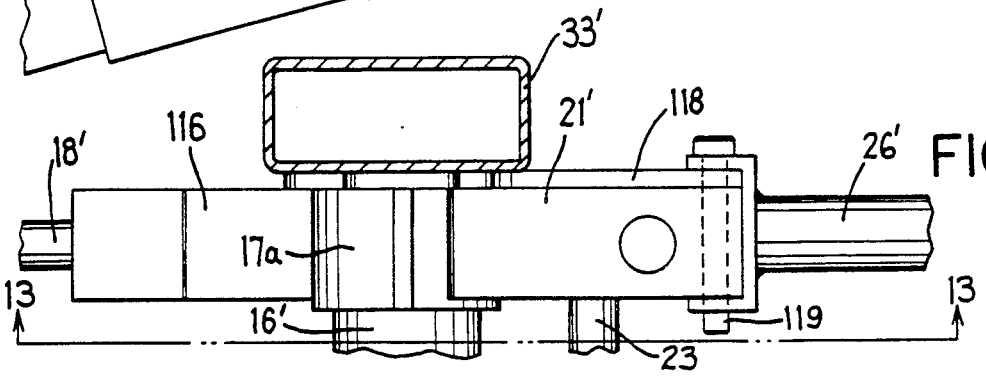

In the wheelchair 10', each of the footrest assemblies 24' is removably attached to a respective one of the front support legs 21'. For this purpose the support rod 26' of the footrest terminates in a channel-like bracket 121 which slidably telescopes downwardly over the nose or leading end of the leg 21' so that the plate 118 is sandwiched therebetween, as illustrated by FIG. 12. The securing pin 119 then extends through openings aligned in all three of the members as illustrated by FIG. 12 so as to fixedly secure them together.

With the wheelchair of the present invention, simply by removing each of the pins 119, which pins are suitably connected to the support leg 21' by a flexible anchoring cable, each of the foot supports 24' can be removed and the upright assembly 12' can be totally disconnected from the wheeled base assembly 11'. In addition, the power source 87' can also be removed from the wheeled base assembly to facilitate handling thereof.

To further facilitate compact storage of the upright assembly 12', the support brackets 37' at the upper ends of the post arrangements have elongated slots extending rearwardly thereof in which the arms 38' are securely supported. The outer ends of the arms 38', however, are hingedly coupled to the bracket 37' by a single hinge pin 121. Hence, when the upright assembly is disconnected from the base, the arms 38' can be pivoted upwardly and forwardly above the hinge pins 121 so as to permit their storage in generally parallel and overlapping relationship with the respective upright post arrangement.

The wheelchair 10' is designed and intended to operate in substantially the same manner as described above relative to the wheelchair 10 in that it can be utilized to permit transfer of an occupant from the chair to a bed or other support, or vice versa, by permitting removal or attachment of the seat assembly. Further, the provision of the vertically telescopic post assemblies enables the seat, when occupied, to be vertically elevated so that the occupant can be at a higher elevation to facilitate access to cupboards or the like, or visibility through windows.

When the support post assemblies are in their lower position, the support arms enable the wheelchair to be moved upwardly and partially under a conventional table so as to be used at mealtimes and the like. In addition, the occupant has the ability to readily propel herself or himself about a house inasmuch as the wheelchair is self-propelled and provides for maximum mobility.

In addition, the wheelchair 10' permits an occupant to be transferred to or from a vehicle. For example, in a manner similar to the operation described above relative to a bed, the wheelchair can be backed up into the open doorway of a vehicle inasmuch as the rear wheel assemblies 19' and the cantilevered rear support legs 18' can pass under a vehicle so that the seat assembly 13' can be positioned directly over a vehicle seat. By then the support posts are lowered so that the wheelchair seat rests directly on vehicle seat. The wheelchair seat can be disconnected and then swiveled about 90 degrees so as to be positioned directly on and over the vehicle seat, thereby permitting transporting of the occupant in the vehicle while maintaining the occupant seated on the wheelchair seat.

The wheelchair seat can then be removed from the vehicle and reconnected to the wheelchair in a generally similar but reverse sequence.

During transporting of the occupant within the vehicle, the wheelchair can be readily disassembled by removing the pins 119 and then folding the support arms 18' over into an upright position whereby the folded upright assembly can then be stored in the vehicle, such as in the trunk. The power pack 87' is then removed from the wheeled base assembly, and the wheeled base assembly and power pack can then also be individually handled and conveniently stored in the vehicle, such as in the trunk. To facilitate this disassembly, all of the electrical cables, where they connect to the power source 87', preferably employ conventional separable pluglike connections.

Although particular preferred embodiments of the invention has been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. A wheelchair, such as for transporting an invalid or handicapped person, comprising:

a wheeled base assembly having a front, a rear and opposite sides;

an upright assembly fixedly secured to and projecting upwardly from said base assembly, said upright assembly including a pair of upright post arrangements located adjacent to said opposite sides of said base assembly and close to the front of said base assembly, each said post arrangement being vertically extendable and retractable;

drive means drivingly coupled to said post arrangements for effecting both raising and lowering thereof;

said upright assembly including a pair of elongate support arm means having front and rear ends, said support arm means adjacent to the front ends thereof being mounted on said post arrangements adjacent to the upper ends thereof, said support arm means projecting rearwardly from said post arrangements in generally parallel and cantilevered relationship; and a seat assembly positioned between and removably attached to said support arm means, said seat assembly including a seat portion and a backrest portion which is normally maintained in upwardly inclined relation to the seat portion when in a seating position, said seat and backrest portions being joined by hinge structure which permits the backrest portion to be folded downwardly into substantially aligned relation with the seat portion, manually releasable catch means coacting between opposite sides of said backrest portion and the respective support arm means in the vicinity of the rear ends thereof to effect partial support of said seat assembly on said support arm means, and manually releasable support means cooperating between opposite sides of said seat portion and the respective support arm means at a location spaced forwardly from the rear ends thereof, said support means including adjustable length means.

2. A wheelchair, such as for transporting an invalid or handicapped person, comprising:

a wheeled base assembly having a front, a rear and two opposite sides, and including a pair of front wheel assemblies adjacent the front and a pair of rear wheel assemblies adjacent the rear, the wheel assemblies of each pair being adjacent the opposite sides;

an upright assembly secured to and projecting upwardly from said base assembly, said upright assembly including a pair of upright post arrangements located adjacent to opposite sides of the base assembly close to the front of said base assembly, each said post arrangement being vertically extendable and retractable;

drive means drivingly coupled to said post arrangements for effecting both raising and lowering thereof;

said upright assembly including a pair of elongate and laterally-spaced support arm arrangements which are mounted on said post arrangements adjacent to upper ends thereof and projecting rearwardly therefrom in generally horizontal and parallel relationship; and a seat arrangement positioned between and removably attached to said support arm arrangements, said seat arrangement including a seat portion and a backrest portion which projects upwardly in transverse relationship to the seat portion, said seat portion being positioned at an elevation below said support arm arrangements and being positioned generally between said post arrangements and projecting rearwardly therefrom, said backrest portion being joined to a rear edge of said seat portion so as to be spaced rearwardly a substantial distance from said upright post arrangements, whereby said seat arrangement opens forwardly between said post arrangements for accessibility from a front side of the wheelchair;

first releasable interconnecting means extending downwardly from an upper front portion of said upright assembly and connected to opposite side edges of said seat portion adjacent the front thereof so that said seat assembly is suspended from said upright assembly and is removably positioned between said post arrangements, and second releasable interconnecting means connected between said support arm arrangements and said backrest portion for releasably but securely connecting said backrest portion to said support arm arrangements.

3. A wheelchair according to claim 2, wherein the space between the seat portion and the base assembly and which projects horizontally rearwardly from the upright post arrangements is open and free of obstructions.

4. A wheelchair according to claim 2, wherein said support arm arrangement are fixedly secured to said post arrangements adjacent upper ends thereof and project generally horizontally rearwardly therefrom in cantilevered relationship so that rearward ends of said support arm arrangements are disposed adjacent opposite sides of the backrest portion.

5. A wheelchair and patient transfer apparatus, comprising:

a wheeled base assembly having a front, a rear and two sides, said base assembly comprising a pair of parallel and generally horizontally extending side legs which extend to the rear of said base assembly and provide an unobstructed space therebetween, said base assembly having crossbar means extending between said side legs close to the front of said base assembly;

a pair of spaced-apart, upright, length-extendible post assemblies having upper and lower ends, said post assemblies having said lower ends secured to said base assembly toward the front thereof, close to said crossbar means and adjacent the front of said side legs of said base assembly, said post assemblies extending upwardly from said base assembly;

a pair of generally parallel, seat support arm arrangements having front and rear ends, said support arm arrangements adjacent the front ends thereof being supported on the upper ends of said post assemblies, said support arm arrangements extending rearwardly from said post assemblies substantially to the rear of said base assembly, said rear ends of said support arm arrangements being unsupported so that said support arm arrangements are cantilevered on said post assemblies;

the space between said post assemblies above said base assembly being unobstructed whereby the feet and legs of a patient can be extended frontwardly between said post assemblies;

a removable patient support assembly comprising a seat portion and a backrest portion which are hingedly connected together, said seat portion extending forwardly and substantially horizontally from close to the rear ends of said seat support arm arrangements to the space between said post assemblies, said seat portion being located below said support arm arrangements a distance such that a patient seated on said seat portion can comfortably rest his/her arms on said support arms, said backrest portion being adapted to extend upwardly substantially between said seat support arm arrangements adjacent to the rear ends thereof;

first releasable interlocking means on said rear ends of said support arm arrangements and on said seat assembly so that said seat assembly can be releasably fixedly connected to the rear ends of said seat support arm arrangements;

second releasable interlocking means connected between the forward ends of said support arm arrangements close to the upper ends of said post assemblies and said seat portion close to the front thereof so that the front of said seat portion can be releasably supported by said support arm arrangements; and third releasable interlocking means interconnecting said seat portion with said backrest portion to normally maintain the backrest portion in an upwardly extending position relative to the seat portion.

6. An apparatus as claimed in claim 5 further including footrest means mounted on said crossbar means and extending forwardly therefrom to a position in front of said post assemblies and close to the lower ends thereof so that a patient seated in said patient support assembly can rest his/her feet on said footrest means.

7. An apparatus as claimed in claim 5 in which each of said post assemblies is comprised of a pair of telescoping members, and power means for relatively extending and retracting said members.

8. A wheelchair and patient transfer apparatus, comprising:

a wheeled base assembly having a front, a rear and two opposite sides;

an upright assembly comprising a pair of spaced-apart, upright, length-extendible post means having upper and lower ends, said post means having said lower ends secured to said base assembly toward the front thereof, said post means extending upwardly from said base assembly;

said upright assembly also comprising a pair of generally parallel, seat support arm arrangements having front and rear ends, said support arm arrangements adjacent the front ends thereof being mounted on the upper ends of said post means, said arm arrangements extending rearwardly from said post means substantially to the rear of said base assembly, the rear ends of said arm arrangements being unsupported so that said support arm arrangements are cantilevered on said post means;

a removable patient support assembly comprising a substantially horizontal seat portion connected to an upright backrest portion, said seat portion extending substantially horizontally from close to the rear ends of said seat support arm arrangements to the space between said post means, said seat portion being located below said seat support arm arrangements a distance such that the torso of a patient seated on said seat portion will be confined between said seat support arm arrangements, said backrest portion being adapted to extend upwardly substantially between said seat support arm arrangements adjacent to the rear ends thereof;

the space between said post means and support arm arrangements and above said base assembly being unobstructed except by said patient support assembly so that the feet and legs of a patient resting on said patient support assembly can be extended frontwardly between said post means and the patient can freely move between the post means either into/or out of the patient support assembly;

first releasable interlocking means on said seat support arm arrangements and on said backrest portion so that said backrest portion can be releasably fixedly connected to said seat support arm arrangements; and second releasable interlocking means connected between said upright assembly close to the front ends thereof and said seat portion close to the front end thereof so that the front of said seat portion is releasably supported by said upright assembly.

* * * * *

UNITED STATES PATENT AND TRADEMARK OFFICE

CERTIFICATE OF CORRECTION

PATENT NO. : 5 112 076

DATED : May 12, 1992

INVENTOR(S) : Harold R. Wilson

It is certified that error appears in the above-identified patent and that said Letters Patent is hereby corrected as shown below:

Column 14, line 12; Claim 4 change "arrangement" to --arrangements--.

Column 16, line 25; Claim 8 change "into/or" to --into or--.

Signed and Sealed this

Twelfth Day of October, 1993

Bruce Lehman

*Attest:*

BRUCE LEHMAN

*Attesting Officer*

*Commissioner of Patents and Trademarks*